US006511070B1

(12) United States Patent
Daines

(10) Patent No.: US 6,511,070 B1
(45) Date of Patent: Jan. 28, 2003

(54) CASINO CARD GAME METHOD

(75) Inventor: Shirley Daines, Red Deer (CA)

(73) Assignee: Canadian 21 Stook Ltd., Red Deer (CA)

( * ) Notice: Subject to any disclaimer, the term of this patent is extended or adjusted under 35 U.S.C. 154(b) by 0 days.

(21) Appl. No.: 09/547,018

(22) Filed: Apr. 11, 2000

(51) Int. Cl.[7] ..... A63F 3/00

(52) U.S. Cl. ..... 273/292; 273/274; 273/306; 273/309

(58) Field of Search ..... 273/236, 292, 273/274, 306, 309

(56) References Cited

U.S. PATENT DOCUMENTS

| | | | | | |
|---|---|---|---|---|---|
| 4,651,997 | A | | 3/1987 | Wood | |
| 5,154,429 | A | | 10/1992 | LeVasseur | |
| 5,174,579 | A | * | 12/1992 | Griffiths | 273/292 |
| 5,257,789 | A | | 11/1993 | LeVasseur | |
| 5,257,810 | A | | 11/1993 | Schorr et al. | |
| 5,275,416 | A | | 1/1994 | Schorr et al. | |
| 5,280,915 | A | * | 1/1994 | Groussman | 273/292 |
| 5,288,082 | A | * | 2/1994 | Marquez | 273/292 |
| 5,328,189 | A | | 7/1994 | Malek | |
| 5,377,993 | A | * | 1/1995 | Josephs | 273/292 |
| 5,413,353 | A | * | 5/1995 | Demarest | 273/292 |
| 5,577,731 | A | * | 11/1996 | Jones | 273/292 |
| 5,632,485 | A | * | 5/1997 | Woodland | 273/292 |
| 5,735,524 | A | * | 4/1998 | Wisted | 273/292 |
| 5,743,532 | A | * | 4/1998 | Lafferty | 273/292 |
| 5,810,360 | A | * | 9/1998 | Srichayaporn | 273/292 |
| 5,816,575 | A | * | 10/1998 | Keller | 273/292 |
| 5,839,730 | A | * | 11/1998 | Pike | 273/292 |
| 5,873,572 | A | | 2/1999 | Huynh | |
| 6,000,699 | A | * | 12/1999 | Long | 273/292 |
| 6,070,873 | A | * | 6/2000 | Perkins | 273/292 |
| 6,095,525 | A | * | 8/2000 | Terminel | 273/292 |
| 6,234,485 | B1 | * | 5/2001 | Perkins | 273/292 |
| 6,293,551 | B1 | * | 9/2001 | Webb | 273/292 |
| 6,305,690 | B1 | * | 10/2001 | Webb | 273/292 |

OTHER PUBLICATIONS

Scarne's Encyclopedia of Games, John Scarne, Harper & Row, 1973—pp. 276–290.*

* cited by examiner

*Primary Examiner*—Benjamin H. Layno
*Assistant Examiner*—Dolores Collins
(74) *Attorney, Agent, or Firm*—Bennett Jones LLP

(57) ABSTRACT

A casino card game is provided wherein the object of the game is to obtain a hand close to or equal to 21 without exceeding 21. A player is given an opportunity to place a raised bet in addition to an initial bet after viewing the player's first card. If a player does place a raised bet, any tie results in a dealer win.

12 Claims, No Drawings

CASINO CARD GAME METHOD

FIELD OF THE INVENTION

The present invention relates to a method of playing a casino card game. In particular, the invention relates to a method of playing a card game which is a variation of blackjack or "21", which are well known in the art.

BACKGROUND TO THE INVENTION

In traditional blackjack, there is no or limited opportunity for a player to increase his or her bet after the player has placed a bet on a given hand. If the player has a favourable first card, the player may wish to increase the bet and may be willing to bear additional risk in doing so. There is no such opportunity in conventional blackjack. Therefore, there is a need in the art for a blackjack style casino card game which permits a player to raise his or her initial bet after receiving and viewing a first card while not skewing the odds in the player's favour by providing such an opportunity.

DETAILED DESCRIPTION OF THE INVENTION

The present invention provides for a method of playing a casino card game between a dealer and at least one player. When describing the present invention, the following terms have the following meanings, unless indicated otherwise. All terms not defined herein have their common art-recognized meanings.

A. Definitions

The term "betting square" refers to an area where a player may place a bet to play a hand against the dealer. A player may play more than one betting square.

The term "dealer" refers to the house employee or agent against whom the player plays the game and who deals the cards as the game is played.

The term "hand" refers to a single set of cards which has been dealt to the dealer or a player, the point value of which is added up to determine the value of the hand.

The term "house" refers to the organisation who provides the game and which earns money from the lost bets of players or loses money to the winning bets of players.

The term "player" refers to an individual who is gambling against the house by playing the game.

The term "natural stook" refers to a hand which has two cards, both of which are Aces.

The term "push" refers to an outcome where neither the player nor the house wins and is the result of a tie in point value between the dealer's hand and the player's hand.

The term "soft hand" refers to a hand which has an Ace card counting as 11 points. All other hands are referred to as a "hard hand".

B. Description

The games of the present invention may be played with a standard deck or decks of playing cards. The primary object for a player of the games of the present invention is to achieve a hand which has a point value closer to 21 than the dealer, without going over 21. In determining the point value of a hand, the following cards have the indicated point value:

TABLE 1

| | |
|---|---|
| Aces | 1 or 11 |
| Face Cards | 10 |
| 2 through 10 | Face Value |

In each game, the dealer's hand is compared to the player's hand and the winner is determined by determining which hand has a point value closer to 21, in accordance with the following list of priority:

TABLE 2

| |
|---|
| 1. Natural stook; |
| 2. A five card hand less than or equal to 21; and |
| 3. Any hand less than or equal to 21. |

A natural stook wins against all other hands except another natural stook. A five card hand wins against all other hands except a natural stook and another five card hand closer to 21. If both dealer and player have a five card hand less than or equal to 21, then whoever is closer to 21 wins. A bust hand is an automatic losing hand.

The basic game is played by first requiring each player to place an initial bet. After each player has placed an initial bet, the dealer begins dealing the cards, first dealing one face down (or face up) card to each player and then one face down card to the dealer. The players may look at their first card. Play then continues with the dealer playing a hand against each player or betting square in turn.

The first player may, after viewing her first card, place a raised bet in addition to the initial bet. In one embodiment, the raised bet may be any amount equal to or greater than the table minimum up to a maximum amount. In one embodiment, the maximum raised bet is equal to four times the initial bet. For example, if the initial bet was 5 dollars, which is the table minimum, the raised bet may be an additional 5 to 20 dollars, for a total bet of 10 to 25 dollars. The player may choose not to raise the bet, in which case play continues.

After permitting the player to place a raised bet, the dealer will deal a second card to the player face up. The player will thereafter indicate to the dealer whether or not additional cards are desired. The player may take as many additional cards as desired, to a maximum of five cards in total. Alternatively, the player may choose to stand by refusing additional cards after receiving the second card or any subsequent card. If at any time the point total exceeds 21, the player's hand is bust and the player loses the initial bet and any raised bet.

When the player stands, the dealer will then turn over the dealer's first card and deal a second card. The dealer must continue to deal himself cards if his hand shows 16 or less and must stand on a hand of hard 17 or more. The dealer will also stop if his hand consists of five cards and he has not exceeded 21. As with the player, if the dealer hand exceeds 21, the dealer's hand is bust and the player wins.

After the dealer has either achieved a point value of hard 17 or more, without exceeding 21, the point value of the player's hand is compared to that of the dealer. The higher point hand wins subject to the priorities listed in Table 2. If the player wins, the house will pay to the player an amount equal to the sum of the initial and raised bet. If the dealer wins, the player will pay to the house all amounts that the player bet. In the event of a tie, the bet is a push, except where the player has placed a raised bet. If the player has placed a raised bet and in the event of a tie, the dealer wins and the player's bets are lost.

In one embodiment, if the player receives an ace as the first card which was dealt face down, the player must turn it over for the dealer to see. If the player then places a raised bet, the player may only take one additional card. If no raised bet is placed, the player may take more than one additional card. If the player's second card is also an ace, the player then wins automatically, unless the dealer also receives two aces as his first two cards, then the bet is a push unless a raised bet was made. If a raised bet was made, the player loses when both player and dealer have two aces.

Once the winner between the dealer and first betting square or player is determined and the bet paid or collected, the dealer then deals himself a new face down initial card and plays against the next betting square or player in the same manner as the first player.

In one alternative embodiment, the house may permit the player to double down after receiving the player's second card. When doubling down, the player places a double down bet which is equal to the initial and raised bet, if any. The player then receives one additional card and no more. In one embodiment, if the dealer makes a natural stook after a player has doubled down, the player loses only the original bet and raised bet but not the double down bet.

In another alternative embodiment, the house may permit the player to split the first two cards if the first two cards are the same. For example, if the player's first two cards are both 7's, regardless of suit, the player may split those cards and play them as separate hands. When a player splits his cards, the player must place an additional bet on the split hand equal to the initial bet and raised bet on the original hand. If the next card dealt to the player is again the same card, the player may split again, to a maximum of four split hands. The first split hand is then played to completion before playing the second or subsequent split hands. The player may double down on a split hand.

In yet another alternative embodiment, if a player has received an Ace as his first card, the house may permit the player to place a limited raised bet whereupon a tie of 20 or 21 would result in a push, rather than a dealer win. A tie of 19 or less would result in a dealer win. The limited raised bet may be to a maximum of twice the initial bet. In this embodiment, the player has the option of such a limited raised bet or the regular higher raised bet (up to a maximum of 4 times the initial bet). In the latter case, the player would lose in the event of any tie with the dealer.

As will be apparent to those skilled in the art, various modifications, adaptations and variations of the foregoing specific disclosure can be made without departing from the scope of the invention claimed herein.

What is claimed is:

1. A method of playing a card game by a dealer and at least one player comprising the steps of:

(a) providing at least one deck of standard playing cards in random order;

(b) allowing each player to place an initial bet in a suitable amount;

(c) dealing one card face down or face up to the player and then one card face down to the dealer;

(d) allowing the player to place a raised bet if the player so desires after viewing the player's initial card, regardless of the value of the player's initial card, in addition to a double down bet, if any;

(e) dealing additional cards, one by one, face up to the player until the player stands, until the player's hand exceeds 21 or until the player hand has five cards, whichever occurs first;

(f) uncovering the dealer's face down card after the player has stopped taking additional cards and dealing additional cards, one by one, to the dealer until the dealer busts, until the dealer reaches a hard 17 or more or until the dealer has five cards, whichever occurs first; and (g) determining the winner as between the dealer and the player in accordance with a pre-determined set of rules.

2. The card game method of claim 1 wherein there are two or more players and the dealer deals a new first dealer card and repeats steps (d) through (g) with the next player after the previous player is finished playing a hand.

3. The card game method of claim 1 wherein the player is permitted to place a raised bet in addition to the original bet to a maximum raised bet of 4 times the original bet.

4. The card game method of claim 3 wherein the player is permitted to place a limited raised bet only if the player has received an Ace as the first card, in which case the outcome is a push only if both player and dealer have 20 or both have 21.

5. The card game method of claim 4 wherein the limited raised bet may be to a maximum of twice the original bet.

6. The card game method of claim 1 further comprising the step of burning the dealer's face down card if the player busts and redealing a face down card to the dealer to play with the next player.

7. The card game method of claim 1 wherein if the player has two aces with his/her first two cards, the outcome is player wins unless the dealer also has two aces with the dealer's first two cards, in which case:

(a) the outcome is a push if there was no raised bet; or (b) the outcome is dealer wins if there was a raised bet.

8. The card game method of claim 1 wherein the dealer must continue to hit as long as the dealer's point value is less than 17, although the dealer may choose to stand upon reaching a soft 17 or a five card had under 21.

9. The card game method of claim 1 wherein the player may double the initial and raised bet after receiving the initial card and one additional card, after which the player must receive one and only one additional card.

10. The card game method of claim 1 wherein the player may split his first two cards if the two cards are the same card by placing an additional bet equal to the player's initial and raised bet, if any, and playing the two split cards as separate hands.

11. The card game method of claim 10 wherein the player may double down on one or both of the split hands after receiving a second card on either or both split hands.

12. The card game method of claim 1 wherein the set of rules is substantially that shown in Table 2 herein.

* * * * *